US009784522B1

(12) United States Patent
Cummings

(10) Patent No.: US 9,784,522 B1
(45) Date of Patent: Oct. 10, 2017

(54) TOY BOW WITH FOLDING ARMS AND INTEGRATED LIGHTING

(71) Applicant: KMA Concepts Limited, Tsim Sha Tsui, Kowloon (HK)

(72) Inventor: Peter John Cummings, Kowloon (HK)

(73) Assignee: KMA Concepts Limited, Tsiu Sha Tsui, Kowloon (HK)

( * ) Notice: Subject to any disclaimer, the term of this patent is extended or adjusted under 35 U.S.C. 154(b) by 0 days.

(21) Appl. No.: 15/398,702

(22) Filed: Jan. 4, 2017

(51) Int. Cl.
*F41B 5/00* (2006.01)

(52) U.S. Cl.
CPC ..... *F41B 5/0094* (2013.01)

(58) Field of Classification Search
CPC .. F41B 5/00; F41B 5/0094; F41B 5/10; F41B 5/14
See application file for complete search history.

(56) References Cited

U.S. PATENT DOCUMENTS 3,628,519 A * 12/1971 Hofmeister ..... F41B 5/0026 124/23.1
3,957,027 A * 5/1976 Drake ..... F41B 5/0026 124/23.1
4,803,970 A * 2/1989 Mattheck ..... F41B 5/0094 124/16
5,247,920 A 9/1993 Harbin
7,748,369 B2 7/2010 Chee
8,662,060 B2 3/2014 Walterscheid et al.
8,689,773 B2 4/2014 Walterscheid et al.
9,151,566 B2 10/2015 Cummings
9,395,141 B2 7/2016 Cummings
9,522,321 B2 12/2016 Cummings

* cited by examiner

*Primary Examiner* — John Ricci
(74) *Attorney, Agent, or Firm* — LaMorte & Associates P.C.

(57) ABSTRACT

A toy bow assembly that is used to launch toy projectiles. The toy bow assembly includes a handle that is used to grasp the toy. The handle has opposite ends. Two arm subassemblies extend from the opposite ends of the handle, wherein the arm subassemblies can articulate between folded positions and extended positions. The arm subassemblies have a spring bias that biases the arm subassemblies into extended positions. Catches are provided in the toy bow assembly for retaining the arm subassemblies in folded positions when the arm subassemblies are articulated into folded positions against the spring bias. Releases are present on the handle that retracts the catches, enabling the arm subassemblies to respond to the spring bias and spring from their folded positions to their extended positions.

18 Claims, 6 Drawing Sheets

TOY BOW WITH FOLDING ARMS AND INTEGRATED LIGHTING

BACKGROUND OF THE INVENTION

1. Field of the Invention

In general, the present invention relates to toy bow and arrow systems where a toy bow is used to launch a toy arrow projectile into flight. More particularly, the present invention relates to the structure of the arms on the toy bow.

2. Prior Art Description

Bow and arrow sets that are designed for children's play have existed throughout recorded history. In the modern era, toy bow and arrow sets typically have a plastic molded bow, a string and safety-tipped arrows. To ensure safety, the functional design of a toy bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of a broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled "Toy Bow"; and U.S. Pat. No. 7,748,369 to Chee, entitled "Launching Apparatus and Assembly".

The applicant has addressed the deficiencies of the prior art by creating a new class of toy bow. The applicant previously created toy bow designs with offset handles. Loops of elastic extend into the open space created by the offset handle. The elastic loops are engaged with a projectile that is specifically designed with side hooks that can engage the elastic loops. Such previous designs are described in U.S. Pat. No. 9,395,141 to Cummings, U.S. Pat. No. 8,662,060 to Walterscheid; and U.S. Pat. No. 8,689,773 to Walterscheid.

In the new class of toy bow, the energy used to launch a projectile is stored in the elastic elements that are used for the loops rather than in the flexing of the bow arms. Accordingly, the bow arms serve little purpose other than to shield the elastic elements and to provide the toy with the appearance of a traditional bow. The change in design enables toy manufacturers to use the arms of the bow for other purposes. For example, in U.S. Pat. No. 9,151,566 to Cummings, the arms of the bow are used to shield the elastic elements from ambient light. In U.S. Pat. No. 9,522,321 to Cummings, the arms of the bow are internally illuminated for aesthetics.

In the current invention, the applicant improves upon prior toy bow designs by returning functionality to the arms of a toy bow that launches projectiles with elastic loops. The arms are not used to provide energy for launching. Rather, the arms are redesigned to provide foldability to the toy bow.

The arms are also integrated with internal lighting to improve the aesthetics and play value of the toy. The details of the improved design are described and claimed below.

SUMMARY OF THE INVENTION

The present invention is a toy bow assembly that is used to launch toy projectiles. The toy bow assembly has a handle that is used to grasp the toy. The handle has opposite ends. Two arm subassemblies extend from the opposite ends of the handle, wherein the arm subassemblies can articulate between folded positions and extended positions. The arm subassemblies have a spring bias that biases the arm subassemblies into extended positions.

Catches are provided in the toy bow assembly for retaining the arm subassemblies in folded positions when the arm subassemblies are articulated into folded positions against the spring bias. Releases are present on the handle that retracts the catches, enabling the arm subassemblies to respond to the spring bias and spring from their folded positions to their extended positions.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy bow assembly can be embodied in many ways, such as a toy crossbow, only one exemplary embodiment of the present invention system is illustrated. This embodiment is selected in order to set forth the best mode contemplated for the invention. The illustrated embodiment, however, is merely exemplary and should not be considered a limitation when interpreting the scope of the appended claims.

Figure 1:
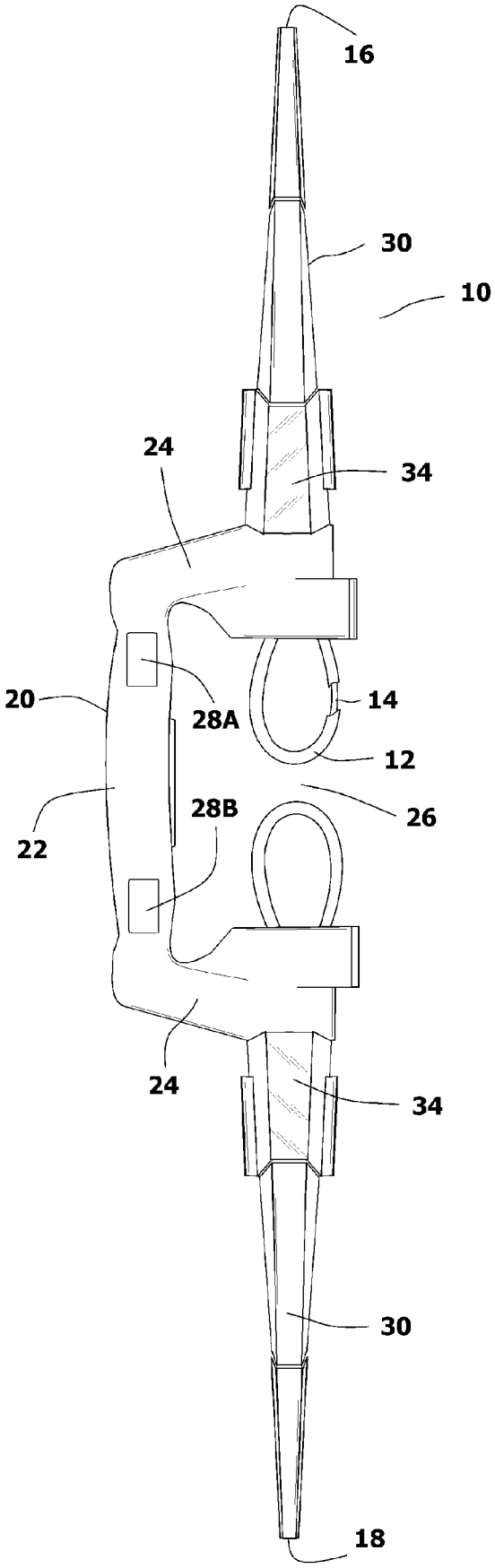
FIG. 1 is a front view of an exemplary embodiment of a toy bow assembly with arms in fully extended positions.
Figure 2:
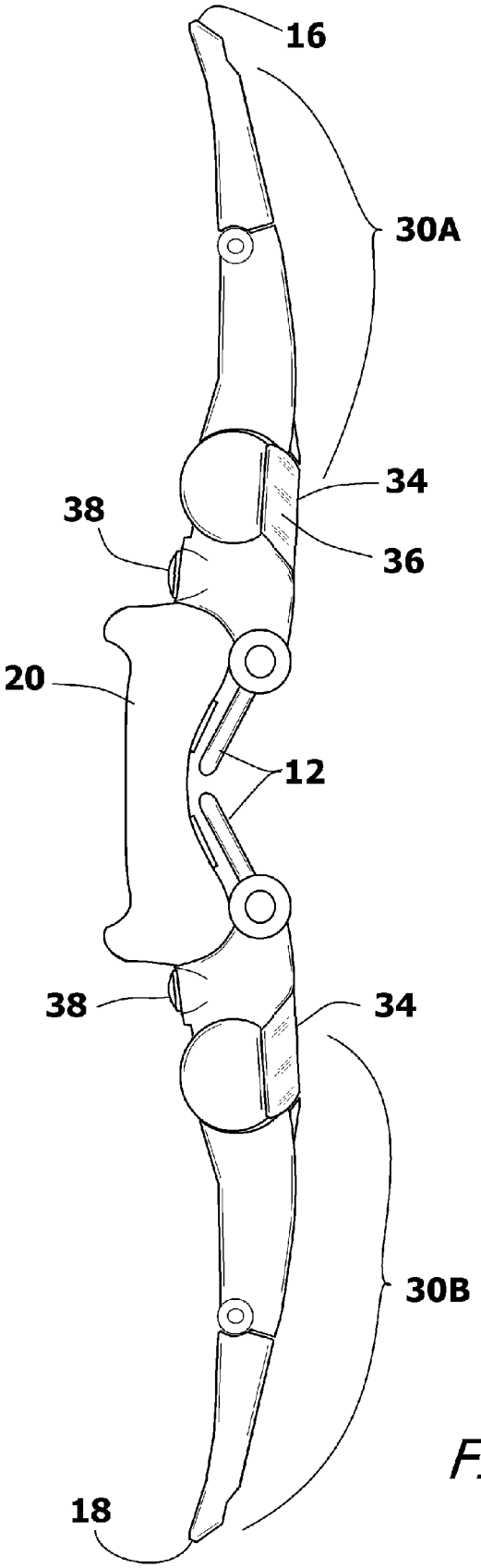
FIG. 2 is a side view of the exemplary embodiment of a toy bow assembly with arms in fully extended positions.

Referring to FIG. 1 in conjunction with FIG. 2, a toy bow assembly 10 is shown. The toy bow assembly 10 is used to launch a toy arrow projectile (not shown). The force used to propel the toy arrow projectile is provided by two separate and distinct loading loops 12. The toy arrow projectile engages both of the loading loops 12. Elastic elements 14 extend through the loading loops 12. As a person engages a toy arrow projectile with the loading loops 12 and pulls on the arrow projectile, the elastic elements 14 in the loading loops 12 stretch. Since there are two loading loops 12, the elastic element 14 in each of the loading loops 12 need only provide half the force needed to propel the toy arrow projectile into flight. The elastic elements 14 are therefore difficult to overstretch in the proper operation of the toy. Furthermore, should either of the elastic elements 14 or loading loops 12 suddenly break, the orientation of the broken elastic elements 14 prevents the elastic elements 14 or the loading loops 12 from whipping toward the user. Lastly, since the arrow projectile engages two separate and distinct loading loops 12, the chances of the elastic elements 14 in both loading loops 12 breaking simultaneously are highly improbable. Accordingly, if one elastic element 14 breaks, the arrow projectile will still be engaged by the other loading loop 12 and the person pulling the arrow projectile back will not pull the arrow projectile into himself upon the breakage of the one elastic element 14.

The toy bow assembly 10 has a first end 16, a second end 18 and an offset handle 20 midway between the first end 16 and the second end 18. The offset handle 20 is generally U-shaped, having a center section 22 set between two lateral arms 24. The toy bow assembly 10 has two arm subassemblies 30. The two arm subassemblies 30 are joined to the lateral arms 24 of the offset handle 20. The two arm subassemblies 30 include a first arm subassembly 30A and a second arm subassembly 30B. The arm subassemblies 30 are oriented in a common vertical plane. The center section 22 of the offset handle 20 is offset from the common vertical plane so as not to interfere with the path of any toy arrow projectile being launched. This creates an open central region 26 between the two arm subassemblies 30 that is adjacent the center section 22 of the offset handle 26.

Figure 3:
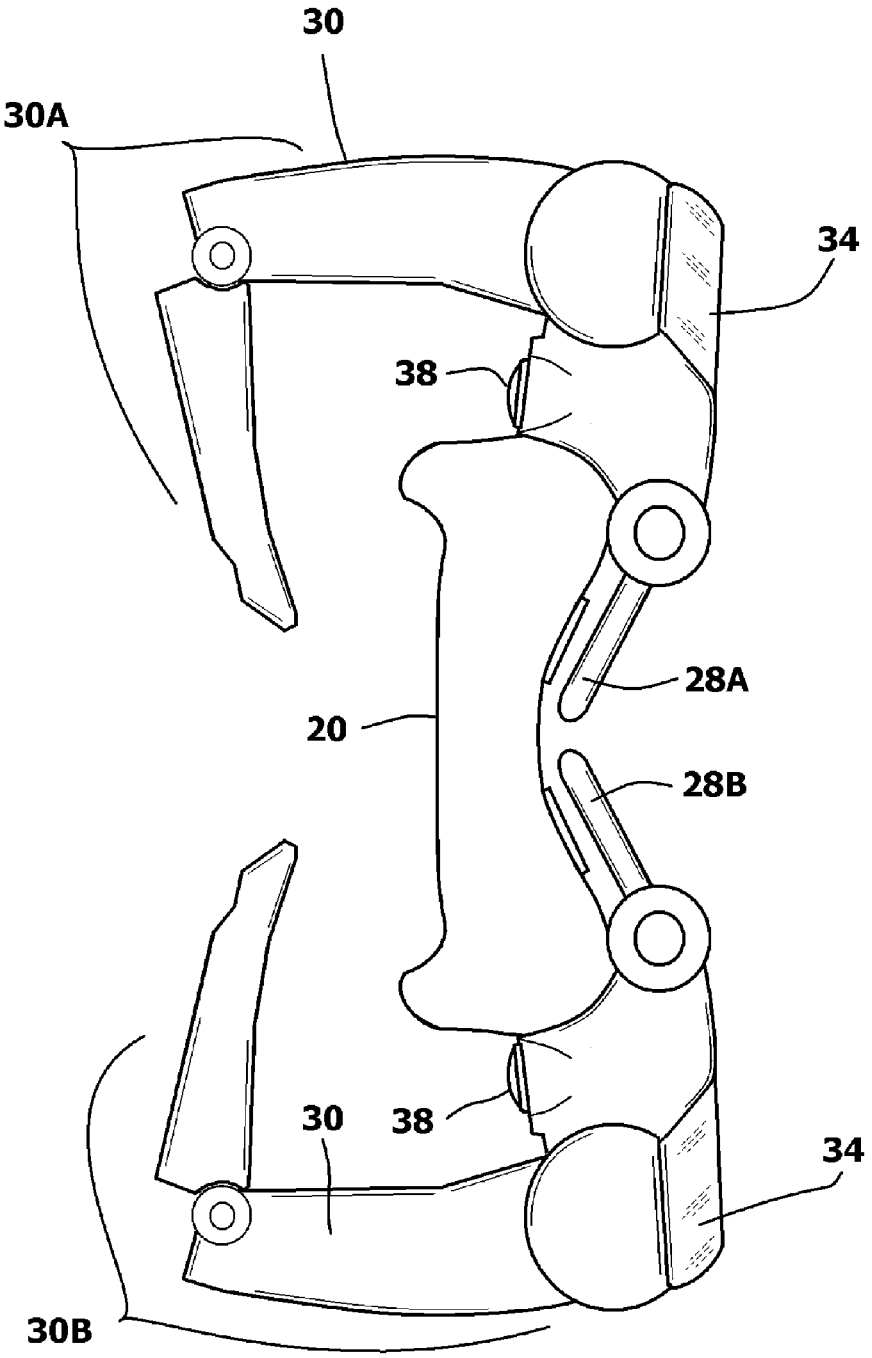
FIG. 3 is a side view of the exemplary embodiment of the toy bow assembly with arms in fully folded positions.

The two arm subassemblies 30 are identical in structure and are mounted in mirrored positions on opposite ends of the offset handle 20. In FIG. 1 and FIG. 2, the arm subassemblies 30 are shown in their fully extended positions. In FIG. 3, the arm subassemblies 30 are shown in their folded positions. The arm subassemblies 30 are spring biased into the extended positions shown in FIG. 1 and FIG. 2. The arm subassemblies 30 can be manually folded against an internal spring bias into the folded positions of FIG. 3. Once manipulated into the folded positions of FIG. 3, the arm subassemblies 30 lock in place in opposition to the internal spring bias. The locked condition can be released through the use of release buttons 28A, 28B. Two release buttons 28A, 28B are disposed on the offset handle 20. The first release button 28A releases the first arm subassembly 30A. The second release button 28B releases the second arm subassembly 30B. It will therefore be understood that the first arm subassembly 30A and the second arm subassembly 30B can be released independently. Once released, the arm subassemblies 30 automatically move into the extended positions shown in FIG. 1 and FIG. 2.

The toy bow assembly 10 also contains internal lighting elements 34 that are positioned in the arm subassemblies 30. The internal lighting elements 34 include a forward light panel 36, that is internally illuminated, and a rearward light panel 38 that is also internally illuminated. Within the arm assemblies 30, the light produced is shielded from the elastic elements 14. As a result, there is no significant light degradation in the polymers of the elastic elements 14 caused by the internal lighting. As such, bright lights can be used without adversely affecting the lifespan of the toy bow assembly 10.

Figure 4:
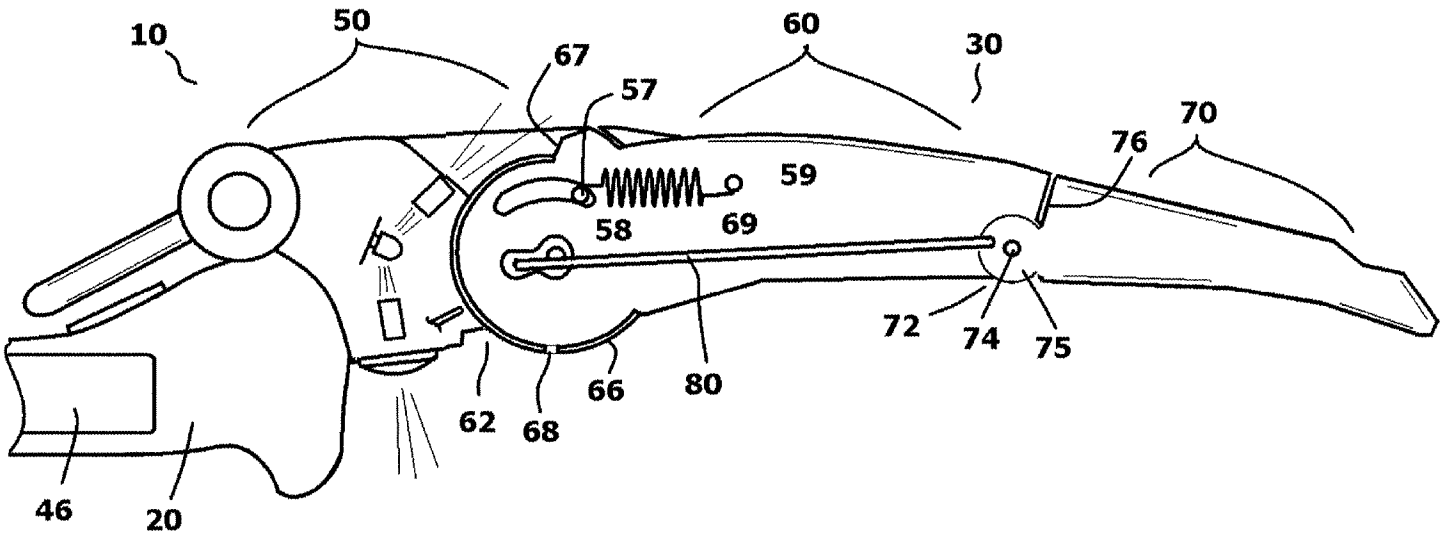
FIG. 4 is a cross-sectional view of an arm in a fully extended position.
Figure 5:
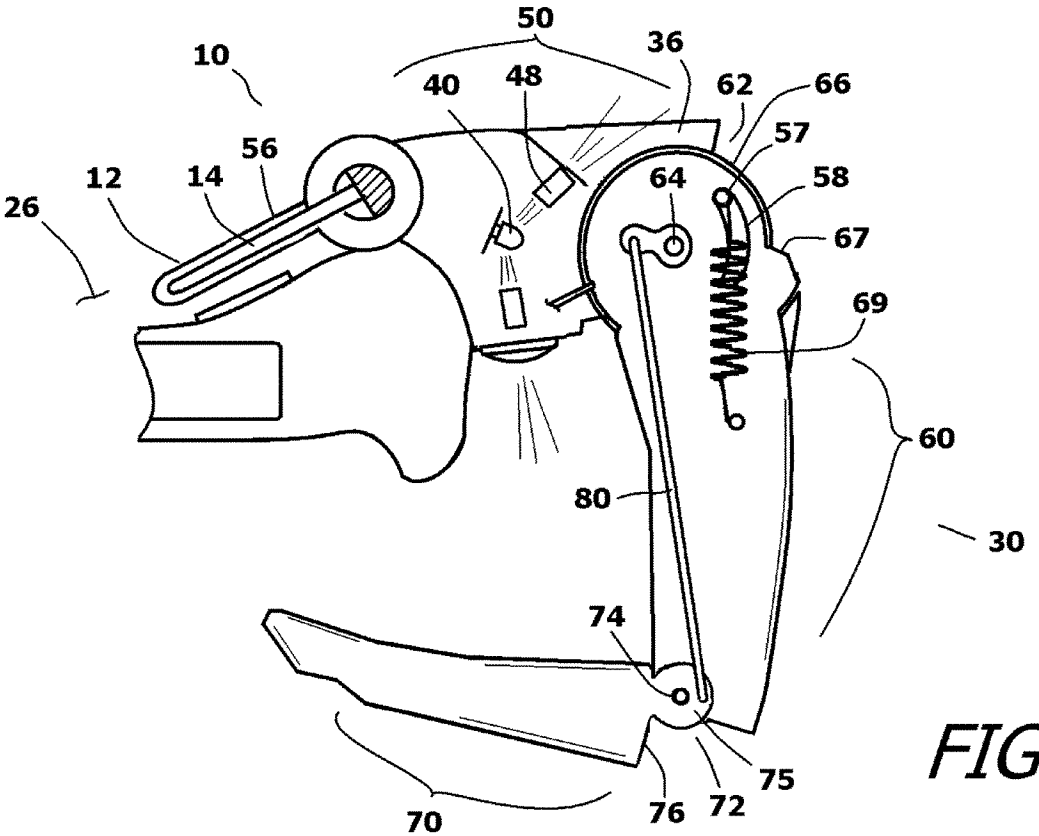
FIG. 5 is a cross-sectional view of an arm in a fully folded position.

Referring to FIG. 4 and FIG. 5, it can be seen that at least one light emitting diode 40 is disposed within each of the arm subassemblies 30. The light emitting diodes 40 are powered by batteries. The batteries are contained within a battery compartment that is manufactured into the toy bow assembly 10. Although a battery compartment can be positioned within the arm subassemblies 30, it is preferred that the battery compartment be placed within the structure of the offset handle 20.

When using the toy bow assembly 10, a person grasps the offset handle 20 of the toy bow assembly 10. As such, it is preferred that an on/off switch 46 be positioned on the offset handle 20 in a position that can easily be operated by a person grasping the offset handle 20. In the preferred embodiment, the on/off switch 46 is normally an "off" switch that turns "on" only when actively pressed. The on/off switch 46 can be integrated into the offset handle 20 so that the on/off switch 46 is activated merely by firmly grasping the offset handle 20 of the toy bow assembly 10.

Each of the arm subassemblies 30 includes three segments. Those three segments include a base segment 50, a middle segment 60 and an end segment 70. The base segment 50 is stationary and is rigidly affixed to the offset handle 20. Inside the base segment 50 is disposed at least one light emitting diode 40. Lens elements 48 are provided that direct light from the LED 40 toward both the forward light panel 36 and the rearward light panel 38. As such, when the light emitting diode 40 is activated both the forward light panel 36 and the rearward light panel 38 are simultaneously illuminated.

The base segment 50 also contains the anchor mount 52 for the elastic element 14. The elastic element 14 has two opposing ends. Both ends are mounted within the anchor mount 52. The result is that the elastic element 14 forms a loop. The loop extends out of the base segment 50 and extends into the open central region 26 adjacent the offset handle 20. A reinforcement tube 56 is provided. The elastic element 14 passes through the reinforcement tube 56 as it loops to create a loading loop 12. The reinforcement tube 56 prevents the elastic element 14 from being worn by repeated contact with the projectile being launched from the loading loops 12.

The base segment 50 of the arm subassembly 30 attaches to the middle segment 60 of the same arm subassembly 30 at a first hinge joint 62. The first hinge joint 62 enables the middle segment 60 to rotate at the first hinge joint 62 relative to the base segment 50. The middle segment 60 of the arm subassembly 30 rotates about a joint pin 64 in the first hinge joint 62. The middle segment 60 has a cam head 66 at one end. The joint pin 64 passes through the center of the cam head 66. A stop 67 is formed on the periphery of the cam head 66. The stop 67 contacts the base segment 50 of the arm subassembly 30 when in its fully extended position. See FIG. 4. As such, the stop 67 prevents the middle segment 60 from over-rotating beyond the fully extended position. A locking depression 68 is also formed on the periphery of the cam head 66. The locking depression 68 is engaged when the arm subassembly 30 is in its fully folded position. As is later explained, when the locking depression 68 is engaged, the middle segment 60 of the arm subassembly 30 is locked into a fixed position and cannot rotate about the first hinge joint 62.

The middle segment 60 is biased into its fully extended position by a spring 69. The spring 69 has one end affixed to an anchor pin 57. The anchor pin 57 is mounted in the first segment 50 and extends through an arcuate slot 58 in the cam head 66. The opposite end of the spring 69 is anchored to a mounting pin 59 on the middle section 60. As the middle segment 60 rotates from its extended position to its folded position, the spring 69 is stretched and stores energy.

The end segment 70 of the arm subassembly 30 is connected to the middle segment 60 of the same arm subassembly 30 at a second hinge joint 72. The second hinge joint 72 enables the end segment 70 to rotate about the second hinge joint 72 relative to the middle segment 60. The end segment 70 of the arm subassembly 30 rotates about a joint pin 74 in the second hinge joint 72. The end segment 70 has a cam head 75 at one end. The joint pin 74 passes through the center of the cam head 75. A stop 76 is formed on the periphery of the cam head 75. The stop 76 contacts the middle segment 60 of the arm subassembly 30 when in its fully extended position. As such, the stop 76 prevents the end segment 70 from over-rotating beyond the fully extended position.

A linkage rod 80 extends from the cam head 66 in the middle segment 60 to the cam head 75 in the end segment 70. As the cam head 66 in the middle segment 60 rotates from its extended position to its folded position, the linkage rod 80 causes the cam head 75 in the end segment 70 to follow. As a consequence, the end segment 70 of the arm subassembly 30 will automatically rotate into its folded position as the middle segment 60 rotates into its folded position. Likewise, when the middle segment 60 rotates into its extended position, the linkage rod 80 will cause the end segment 70 to also rotate into its extended position.

Figure 6:
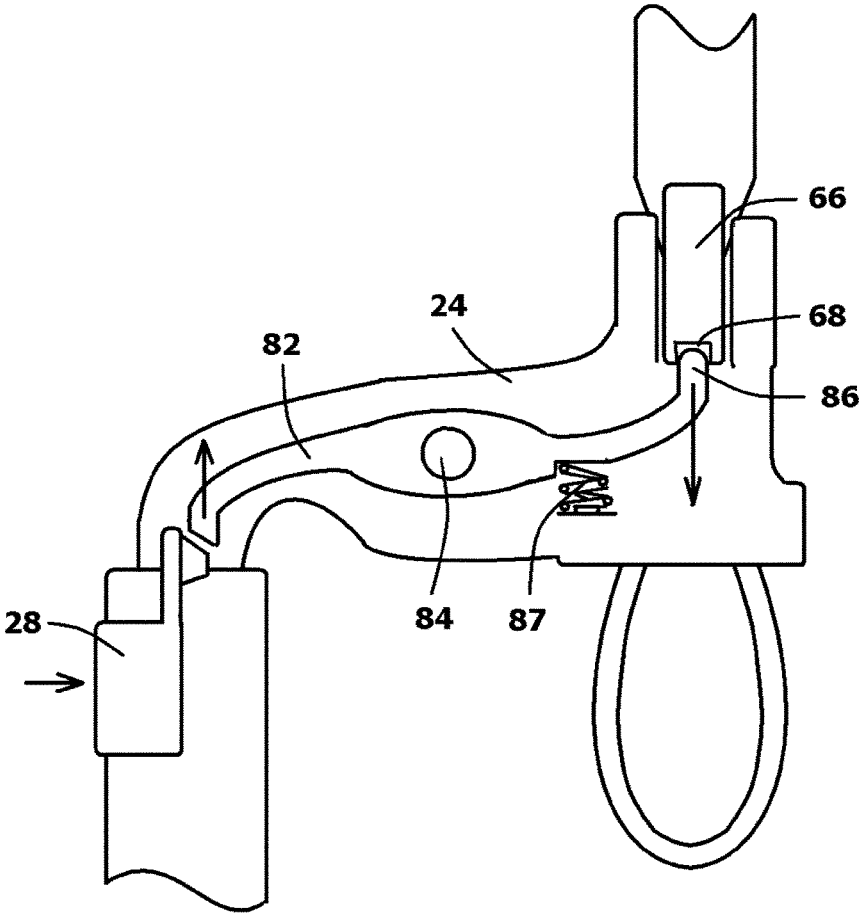
FIG. 6 shows a cross section of a section of the handle to expose the workings of an internal release mechanism.

Referring to FIG. 6 in conjunction with FIG. 4 and FIG. 5, it can be seen that a rocker linkage 82 extends through the lateral arms 24 of the offset handle 20. The rocker linkage 82 has a pivot 84 near its center. The release buttons 28 on the offset handle 20 are mechanical buttons. When a release button 28 is depressed, it drives one end of the rocker linkage 82 upwardly. The rocker linkage 82 teeters about a pivot 84. This causes the opposite end of the rocker linkage 82 to move downward. A catch 86 is formed at the second end of the rocker linkage 82. The catch 86 is normally biased upwardly by a spring 87 into the locking depression 68 on the cam head 66 of the middle segment 60 of the arm subassembly 30. However, when the release button 28 is pressed, the rocker linkage 82 moves down against the bias of the spring 87 until the locking protrusion 86 is free of the locking depression 68. If will therefore be understood that when the release button 28 is not pressed, the lock protrusion 86 is biased upwardly and will automatically engage the locking depression 68 in the cam head 66 as the arm subassembly 30 is manually moved into its folded position. As soon as the release button 28 is pressed, the cam head 66 is free to rotate and the arm subassembly 30 will spring into its extended position.

It will be understood that the embodiment of the present invention that is illustrated and described is merely exemplary and that a person skilled in the art can make many variations to that embodiment. For instance, the bow structure can have many different ornamental shapes. The bow structure can also take the form of a crossbow. All such embodiments are intended to be included within the scope of the present invention as defined by the claims.

What is claimed is:

1. A toy bow assembly comprising:

a handle having opposite ends;

two arm subassemblies extending from said opposite ends of said handle, wherein said arm subassemblies can articulate between folded positions and extended positions, and wherein said arm subassemblies have a spring bias that biases said arm subassemblies into said extended positions;

catches for retaining said arm subassemblies in said folded positions when articulated into said folded positions against said spring bias; and releases for retracting said catches and enabling said arm subassemblies to respond to said spring bias and spring from said folded positions to said extended positions.

2. The assembly according to claim 1, wherein said releases are accessible on said handle.

3. The assembly according to claim 1, wherein each of said arm subassemblies includes segments that are joined with hinge joints, wherein said segments rotate about said hinge joints when articulating between said extended positions and said folded positions.

4. The assembly according to claim 3, wherein said arm subassemblies each contain at least three segments and two hinge joints.

5. The assembly according to claim 1, wherein each of said arm subassemblies includes a base segment, an end segment and a middle segment disposed between said base segment and said end segment.

6. The assembly according to claim 5, wherein said base segment is rigidly affixed to said handle.

7. The assembly according to claim 6, wherein said middle segment is attached to said base segment at a first hinge joint, wherein a spring extends between said base segment and said middle segment that provides said spring bias.

8. The assembly according to claim 7, wherein said end segment is attached to said middle segment at a second hinge joint.

9. The assembly according to claim 8, wherein a linkage arm extends from said first hinge joint to said second hinge joint that causes said second hinge joint to move in response to movements experienced in said first hinge joint.

10. The assembly according to claim 1, wherein said arm subassemblies both contain at least one panel that is internally illuminated.

11. The assembly according to claim 1, wherein said arm subassemblies both contain a first panel that faces in a first direction and a second panel that faces in a direction opposite said first direction that are internally illuminated by a common light source.

12. A toy bow assembly comprising:

a first arm having multiple segments that are connected at hinge joints, wherein said first arm has an internal spring bias that biases said first arm into an extended position, wherein said first arm can be folded about said hinge joints in opposition to said spring bias into a folded position;

a catch for retaining said first arm in said folded position when articulated into said folded position against said spring bias; and a manually operated release for retracting said catch and enabling said arm to spring from said folded position to said extended position.

13. The assembly according to claim 12, further including a handle, wherein said release is accessible on said handle.

14. The assembly according to claim 13, wherein said first arm includes a base segment, an end segment, and a middle segment disposed between said base segment and said end segment.

15. The assembly according to claim 14, wherein said base segment is rigidly affixed to said handle.

16. The assembly according to claim 15, wherein said middle segment is attached to said base segment at a first hinge joint, wherein a spring extends between said base segment and said middle segment that provides said spring bias.

17. The assembly according to claim 16, wherein said end segment is attached to said middle segment at a second hinge joint.

18. The assembly according to claim 17, wherein a linkage arm extends from said first hinge joint to said second hinge joint that causes said second hinge joint to move in response to movements experienced in said first hinge joint.

* * * * *